US005596340A

United States Patent [19]

Otomi

[11] Patent Number: 5,596,340

[45] Date of Patent: Jan. 21, 1997

[54] THREE-DIMENSIONAL IMAGE DISPLAY DEVICE

[75] Inventor: Koichi Otomi, Kanagawa-ken, Japan

[73] Assignee: Kabushiki Kaisha Toshiba, Kawasaki, Japan

[21] Appl. No.: 983,150

[22] Filed: Nov. 30, 1992

[30] Foreign Application Priority Data

Nov. 29, 1991 [JP] Japan ..... 3-315639

[51] Int. Cl.[6] ..... G09G 3/00

[52] U.S. Cl. ..... 345/31; 345/139

[58] Field of Search ..... 345/6, 31, 39, 345/56, 139; 250/201.1, 201.2, 61.45 R, 61.53; 340/815.45, 815.83

[56] References Cited

U.S. PATENT DOCUMENTS

| | | | |
|---|---|---|---|
| 4,160,973 | 7/1979 | Berlin | 345/31 |
| 4,225,862 | 9/1980 | Johnson | 345/31 |
| 4,743,748 | 5/1988 | O'Brien | 345/31 |
| 5,202,675 | 4/1993 | Tokimoto | 345/31 |

FOREIGN PATENT DOCUMENTS

| | | |
|---|---|---|
| 64-72691 | 3/1989 | Japan . |
| 1-193836 | 8/1989 | Japan . |

OTHER PUBLICATIONS

"Interactive volume scanning 3–D display with an optical relay system and multidimensional input devices" vol. 1915 The International Society for Optical Engineering, Feb. (1933) by Ken–ichi Kameyama et al.

"Virtual Surgical Operation System Using Volume Scanning Display" vol. 2164 The International Society for Optical Engineering, Feb. 1994 by Ken–ichi Kameyama et al.

"A Shape Modeling System with a Volume Scanning Display and Multisensory Input Device" vol. 2 The Massachusetts Institute of Technology 1993, pp. 104–111 by Ken–ichi Kameyama et al.

"VR System Using Volume Scanning Display and Multi-Dimensional Input Device" The Society of Instrument and Control Engineers of Japan, Nov. 1992, pp. 473–479, by Ken–ichi Kameyama et al.

"An Interactive Volumetric Display System" TAO First International Symposium, Dec. 1993 by Ken–ichi Kameyama et al.

"A Virtual Reality System Using a Volume Scanning 3D Display" International Conference and Artificial Reality and Tele–existence, by Ken–ichi Kameyama et al.

"A Direct 3–D Shape Modeling System" Virtual Reality Annual International Symposium, Sep. 1993, pp. 519–524, by Ken–ichi Kameyama et al.

P. Halliday & R. Resnick, "Fundamentals of Physics" 2nd Ed. Wiley & Sons 1986. pp. 258–259.

Edwards, S. "The Picture Stick" Electronics Now, Oct. 1994 pp. 35–41.

*Primary Examiner*—Richard Hjerpe
*Assistant Examiner*—Kara Farnandez Stoll
*Attorney, Agent, or Firm*—Oblon, Spivak, McClelland, Maier & Neustadt, P.C.

[57] ABSTRACT

A three-dimensional image display device includes a display plate for producing light-emission or optical variations by an external electrical, magnetic, or optical operation, or a display member for arranging LEDs in matrix, a drive circuit for vibrating the display plate in a specified direction with respect to the display surface of the display plate, a shape data memory for storing two-dimensional sectional images for displaying on the display plate, through an input circuit, a position detector for detecting the position of the display plate while the display plate is vibrating, a controller for controlling so that a specified part of the display plate emits light or produces an optical variation for a specified time only, utilizing positional data from the position detector to display the two-dimensional sectional images on the display plate in sequence while the display plate is vibrating.

21 Claims, 12 Drawing Sheets

DISPLAY OBJECT

THREE-DIMENSIONAL IMAGE DISPLAY DEVICE

BACKGROUND OF THE INVENTION

1. Field of the Invention

The present invention relates to a three-dimensional image display device for displaying data in three-dimensional form within the movable space of a display means.

2. Description of the Prior Art

Conventionally, an object in three-dimensional form displayed as an image on a display device can generally be only displayed as a two-dimensional image. However, in recent years devices have been developed and used for displaying such objects in three-dimensional form.

Examples of conventional devices for displaying three-dimensional images include a three-dimensional image display device which displays on a display device a number of images obtained from two photographic devices arranged at a specified spacing, and by which a three-dimensional image can be recognized by viewing through special spectacles which have the function of shuttering the image and a three-dimensional viewing device for displaying a three-dimensional image of an object on a display device by computer graphics.

However, because it is necessary to use the two photographic devices and the special spectacles with the function of shuttering the image with the viewing device which uses the special spectacles with the function of shuttering the image, handling and operation are troublesome, and there is an inadequate sense of three-dimensionality of the object when viewed through the spectacles. The results of this method of viewing also differ by individual.

In addition, setting the viewing points is troublesome with the three-dimensional image display device which uses computer graphics, and, in addition, a large number of calculations and the like are required to create an image which provides a sense of reality each time the viewing points are changed. It is therefore difficult to effectively display a three-dimensional image.

SUMMARY OF THE INVENTION

Accordingly, an object of the present invention is to provide, with due consideration to the drawbacks of such conventional devices, a three-dimensional image display device which can easily represent three-dimensional shapes and their movement in a three-dimensional manner.

The present invention provides for a three-dimensional image display device having:

display means comprising a plurality of display elements for producing light-emission or optical variations by means of an external electrical, magnetic, or optical operation, or a display member for arranging an optical material two-dimensionally;

drive means for vibrating the display means in a specified direction with respect to the display surface of the display means;

shape data memory means for storing two-dimensional sectional images for displaying on the display means, through an input means;

position detection means for detecting the position of the display means while the display means is vibrating;

control means for controlling so that a specified part of the display means emits light or produces an optical variation for a specified time only, utilizing positional data from the position detection means in order to display the two-dimensional sectional images on the display means in sequence while the display means is vibrating.

In addition, the three-dimensional image display device described above, wherein a flexible member is interposed between the display means and the drive means.

Further, the three-dimensional image display device described above, wherein the control means causes the two-dimensional sectional images to be displayed in sequence in the advancing and retreating paths of the display means while the display means is vibrating.

Moreover, the three-dimensional image display device described above, wherein the control means have:

amplitude position display means attached to the display means and for displaying a plurality of vibrational position data items on the display member within the amplitude while the display means is vibrating, and for displaying reset positional data for transmitting data for two-dimensional sectional images to the display means; and a position detection sensor for reading the data for the amplitude position display means;

Furthermore, the three-dimensional image display device described above, wherein the position detection means detects each specified position of tile advancing and retreating paths of the vibrating display means, and the two-dimensional sectional image is displayed in each of the advancing and retreating paths of the display means while the display means is vibrating, by the control means, corresponding to a signal from the position detection means.

The present invention also offers a three-dimensional image display device comprising:

display means comprising: in turn, a plurality of display elements for producing light-emission or optical variations by means of an external electrical, magnetic, or optical operation, or a display member for arranging an optical material two-dimensionally;

drive means for vibrating the display means in a specified direction with respect to the display surface of the display means;

a flexible member positioned between the display means and the drive means;

shape data memory means for storing two-dimensional sectional images for displaying on the display means via an input means;

position detection means for detecting the position of the display means while the display means is vibrating; and control means for controlling so that a specified part of the display means emits light or produces an optical variation for a specified time only, utilizing positional data from the position detection means in order to display the two-dimensional sectional images on the display means in sequence while the display means is vibrating, wherein the display means is vibrated at the drive frequency of the drive means so that the vibration characteristics of the flexible member are tuned almost in agreement with an intrinsic frequency determined by the drive means, the flexible member, and the display means, or the drive frequency is made almost equivalent to the intrinsic frequency.

Furthermore, the present invention also provides for a three-dimensional image display device comprising:

- display means having, in turn, a plurality of display elements for producing light-emission or optical variations by means of an external electrical, magnetic, or optical operation or a display member for arranging an optical material two-dimensionally;
- drive means for vibrating the display means in a specified direction with respect to the display surface of the display means;
- shape data memory means for storing two-dimensional sectional images for displaying on the display means through an input means;
- position detection means for detecting each vibrating position of the display means and each initial position of the advancing and retreating paths of the display means while the display means is vibrating;
- control means for controlling so that a specified part of the display means emits light or produces an optical variation for a specified time only, at a specified vibrational position of the display means after detecting each initial position of the advancing and retreating paths of the vibrating display means utilizing positional data from the position detection means, and for controlling so that the two-dimensional sectional layer images are displayed in sequence in each of the advancing and retreating paths of the display means while the display means is vibrating.

These and other objects, features, and advantages of the present invention will become more apparent from the following description of the preferred embodiment taken in conjunction with the accompanying drawings.

DETAILED DESCRIPTION OF THE PREFERRED EMBODIMENTS

Other Features of this invention will become apparent in the course of the following description of exemplary embodiments which are given for illustration of the invention and are not intended to be limiting thereof. Embodiments of tile present invention will now be explained with reference to the drawings.

<First Embodiment>

Figure 1:
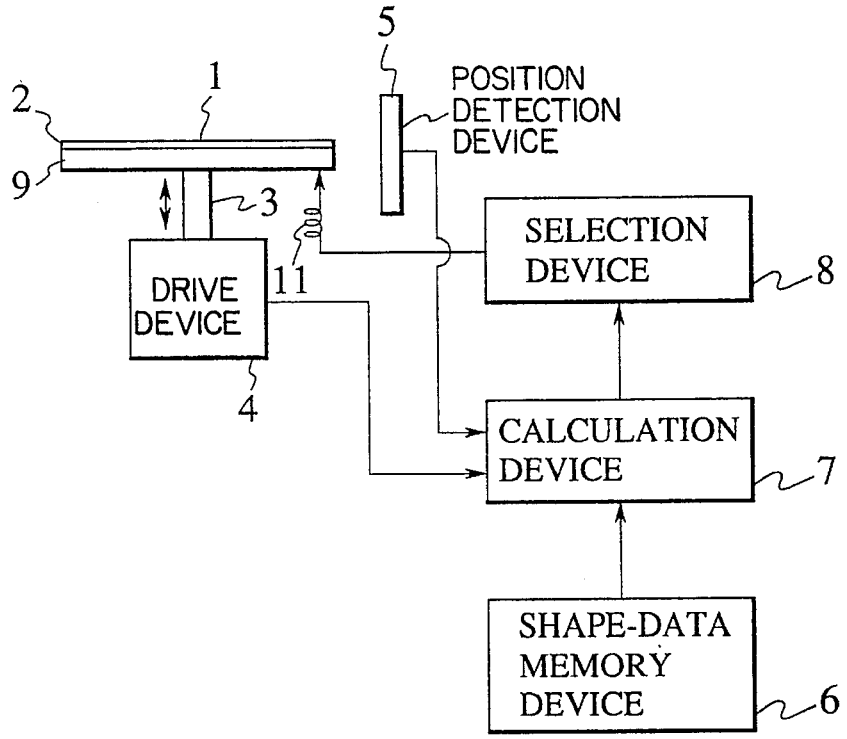
FIG. 1 is a general configuration drawing showing a first embodiment of a three-dimensional image display device of the present invention.

FIG. 1 is a general configuration drawing showing a first embodiment of a three-dimensional image display device of the present invention.

As shown in FIG. 1, this embodiment of the three-dimensional image display device comprises a display section 2 on which is positioned a plurality of light emitting elements 1 such as an LED (light-emitting diode) or the like in a flat plane;

- a drive device 4 which vibrates the display section 2 at, for example, right angles (the direction shown by the arrows) to the light emitting surface (the upper surface of the display section 2 in the drawing) of the light emitting element 1 through a drive rod 3;
- a position detection device 5 for detecting the position of the display section 2 which is being driven;
- a shape-data memory device 6 for storing data relative to two-dimensional sectional images corresponding to three-dimensional shapes for display in the display section 2 to display three-dimensional shapes in a display space;
- a calculation device 7 for making calculations for causing light emission from an optional light emitting element 1 of the display section 2 at a specified position during a specified time only; and
- a selection device 8 for selecting the desired light emitting elements 1 of the display section 2 based on the results of calculations obtained from the calculation device 7, and for outputting to the light emitting elements 1 a signal to emit light for a specified time.

Figure 2:
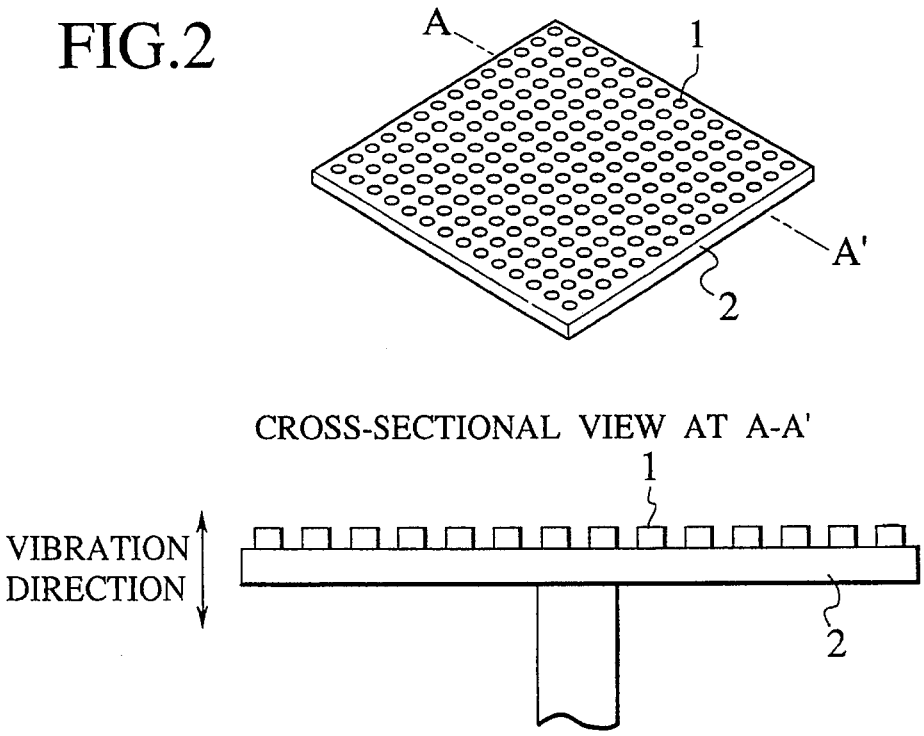
FIG. 2 is a perspective diagram showing a display section.

In the display section 2, a plurality of light emitting elements 1 such as LEDs or the like is systematically arranged in matrix on a pedestal 9 (see FIG. 2) and the individual light emitting elements 1 are independently controlled to the ON or OFF state respectively under the control of the calculation device 5 and the selection device 8.

The drive device 4 is provided with a conversion means (omitted from the drawing) such as a crank or the like for converting rotary motion to reciprocating motion. One end of the drive rod 3 is linked to the display section 2 and the other end of the drive rod 3 is connected to the conversion means. The reciprocating action of the drive device 4 causes the display section 2 to vibrate at right angles (the vertical direction in the drawing) with respect to the light emitting surface (the upper surface of the display section 2 in the drawing) of the light emitting element 1.

The position detection device 5 is provided with a position detection sensor (for example, a non-contact type excess current sensor, or a laser sensor, or the like), and the display section 2 detects the vibrational position of the light emitting element 1 during vibration, in real time.

Data relative to two-dimensional sectional shapes for display in the display section 2 through an input device (omitted from the drawing) such as a keyboard, a mouse, an image reading scanner, or the like is stored in the shape-data memory device 6.

The calculation device 7 receives data for two-dimensional sectional shapes input from the shape-data memory device 6, vibrational position data for the display section 2 input from the position detection device 5, and frequency data for the display section 2 input from the drive device 4, and performs calculations based on this data to cause light emission during a specified time only at a specified position of a desired display element in the display section 2 for displaying the two-dimensional sectional shapes which are stored in the shape-data memory device 6.

The selection device 8 selects the desired light emitting elements 1 for displaying the three-dimensional shapes based on the results of calculations obtained from the calculation device 7, and outputs to the selected desired light emitting elements 1 a signal to emit light for a specified time only combined with the vibration of the display section 2.

Next, an operation for displaying data in three-dimensional form with this embodiment of the three-dimensional image display device of the present invention will be explained.

Figure 3:
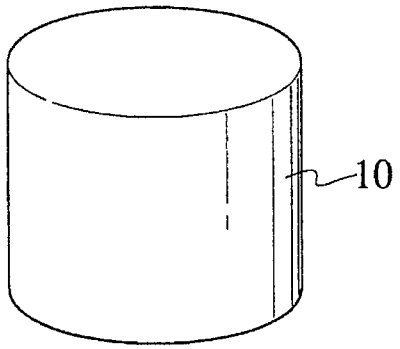
FIG. 3 is a perspective diagram showing one example of a three-dimensional shape.

First, data for a three-dimensional shape to be displayed in the display section 2 (for example, a cylinder 10 as illustrated in FIG. 3) is input through an input device (omitted from the drawing) such as a keyboard or the like. Then, each of two-dimensional sectional images corresponding to the three-dimensional shape required to be displayed is generated. Finally, the two-dimensional sectional images are stored in the shape-data memory device 6.

The display section 2 is then caused to vibrate (reciprocating motion) at right angles (the vertical direction in the drawing) with respect to the light emitting surface (the upper surface of the display section 2 in the drawing) of the light emitting element 1 through the drive rod 3, as the result of the reciprocating motion by the drive device 4. When the size of the display section 2 is 5 to 15 cm by 5 to 15 cm, the frequency of vibration (reciprocating motion) of the display section 2 at this time is about 600 to 2000 times per minute, and the amount of vertical displacement (amplitude) is about 5 to 15 cm to obtain an adequate residual image effect. In addition, for example, when the size of the display section 2 is approximately 50 cm by 50 cm, the amount of vertical displacement (amplitude) is about 50 cm. The amount of vertical displacement and the amount of the frequency of vibration are changed corresponding to the amount of display section 2.

Figure 4:
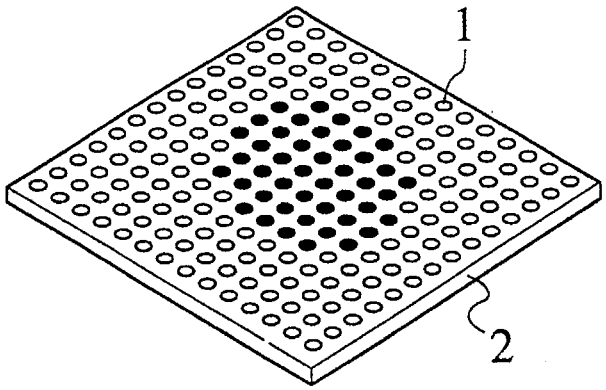
FIG. 4 is a perspective diagram showing desired light-emitting elements of the display section in the light-emitting state.

The calculation device 7 then receives frequency data for the display section 2 input from the drive device 4, position data for the display section 2 input from the position detection device 5, and data for two-dimensional sectional images input from the shape-data memory device 6, and performs calculations to cause light emission during a specified time only at each vibrational position of the desired light emission elements 1 in the display section 2 which is vibrating in the vertical direction, to display the three-dimensional shapes which have been stored in the shape-data memory device 6. The selection device 8 selects the light emitting elements 1 which emit light at each vibrational position of the vibrating display section 2 based on the results of calculations from the calculation device 7, and outputs a light emission signal for a specified time only, combined with the vibration of the display section 2, to each vibrating light emitting element 1, thus causing light to be emitted from the desired light emitting elements 1. For example, FIG. 4 is an example of a light-emission pattern of the light emitting elements 1 on the display section 2 at a certain instant. In this manner, the light emitting elements 1 are caused to emit light in a round shape (black portion).

Therefore, the desired light emitting elements 1 positioned in a flat plane can display three-dimensional shapes directly in three-dimensional space by displaying continuously the two-dimensional sectional images by emitting light combined with vibration, utilizing the residual image effect of human vision. At this time, the higher the amplitude of the display section 2, the greater the volume of the three-dimensional shapes in the three-dimensional space displayed by the display section 2.

In addition, the greater the speed of vibration (reciprocating motion) of the display section 2, the greater the residual image effect, and the closer the positioning of the light emitting elements 1, the clearer the display which can be achieved. Further, with this embodiment, a signal line 11 in the form of a coil is led off from each of the light emitting elements 1 of the display section 2 to the selection device 8. The total weight of these signal lines 11, compared to the total weight of the display section 2, has almost no effect on the drive by the drive device 4 and can be formed at a comparatively light weight, therefore, the vibrating (reciprocating motion) operation of the display section 2 by the drive device 4 is almost unaffected.

<Second Embodiment>

A second embodiment of the three-dimensional image display device of the present invention will now be explained.

Figure 5:
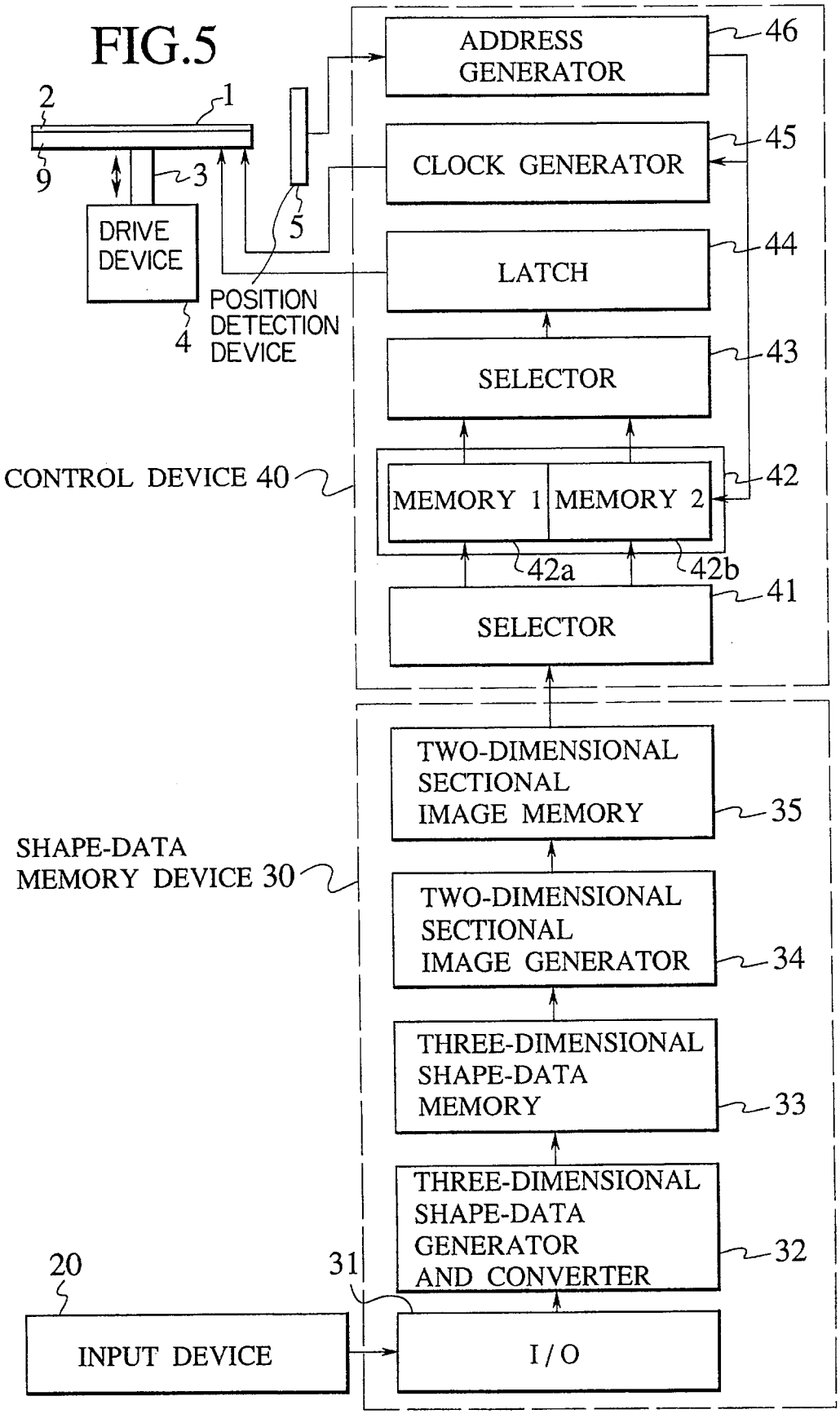
FIG. 5 is a general configuration drawing illustrating the second embodiment of the three-dimensional image display device of the present invention.

FIG. 5 is a general configuration drawing illustrating the second embodiment of the three-dimensional image display device of the present invention. The special parts of this embodiment are a shape-data memory device 30 and a control device 40. A detailed description of other parts, for which like reference numerals designate identical or corresponding parts in the first embodiment shown in FIG. 1, is omitted.

First, a display section 2, on which a plurality of light-emitting elements such as LEDs or the like is arranged in a two-dimensional form or in a matrix form in the same manner as in the first embodiment, is constructed so that it can be vibrated by means of a drive device 4 at, for example, right angles to the display surface of the display section 2 through a drive rod 3. In addition, the position of the display section 2 can be detected by a position detecting device 5.

Next, the general configuration and operation of the second embodiment of the three-dimensional imaging device will be explained. Data related to a three-dimensional figure or a three-dimensional image for display in the display space is input to the shape-data memory device 30 from an input device 20 which may be a keyboard, a mouse, or an image-reading scanner, or the like. When inputting a three-dimensional figure from a keyboard, a mouse, or the like, for example, specific coordinates are input for the three-dimensional figure. When a three-dimensional image or a two-dimensional sectional image is input from an image-reading scanner, these are introduced directly as a three-dimensional image or a two-dimensional sectional image from, for example, a CCD scanner or the like.

The shape-data memory device 30 mainly comprises an I/O device 31, a three-dimensional shape generator/converter 32. a three-dimensional shape memory 33, a two-dimensional sectional image generator 34, and a two-dimensional image memory 35. The I/O device 31 accepts various types of commands from the input device 20. If, for example, a command to input coordinates for a three-dimensional shape is received, the I/O device 31 starts the three-dimensional shape preparation/modification device 32, and prepares a three-dimensional shape.

If a command to convert a three-dimensional shape is received (modification of the dimensions, or modification of the shape itself, or the like), a previously-prepared three-dimensional shape is read out of the three-dimensional shape memory 33, the three-dimensional shape generation/conversion device 32 is started, and the dimensions of that three-dimensional shape or the shape itself is modified. In addition, even when data is input as a three-dimensional image by an image-reading scanner or the like, the three-dimensional shape generation/conversion device 32 is started and this data is converted into the necessary data as a three-dimensional shape. Also, when data is input as a two-dimensional sectional image from an image-reading scanner, the two-dimensional sectional image generator 34 may be started directly and the two-dimensional sectional image is generated directly. Data for a three-dimensional shape, generated or converted in this manner by means of the three-dimensional shape generation/conversion device 32 through the input device 20, is stored as required in the three-dimensional shape memory 33. The three-dimensional shape data stored in the three-dimensional shape memory 33, or the three-dimensional shape data generated or converted by means of the three-dimensional shape generation/conversion device 32, is then transmitted to the two-dimensional sectional layer image generator 34. A plurality of two-dimensional sectional images is generated by the two-dimensional sectional image generator 34 for display on the display part 2. These two-dimensional sectional images are specified, sequentially-prepared parts of sectional images of three-dimensional shapes as previously described, therefore when the display section 2 is caused to vibrate and these two-dimensional sectional images are sequentially displayed they are perceived as a three-dimensional shape as a result of the residual image effect of human vision.

Then, the two-dimensional sectional images generated by the two-dimensional sectional image generator 34 are transmitted to and stored in the two-dimensional sectional image memory 35.

The shape data in the two-dimensional sectional image memory 35 is transmitted to the display section 2 through the control device 40.

The control device 40 mainly comprises the following structural elements. Specifically, the control device 40 comprises a selector 41, a buffer memory 42, a selector 43, a latch 44, a clock signal generator 45, and an address generator 46.

In the second embodiment of the present invention the buffer memory 42 comprises two buffer memories **42*a* and 42*b* (a memory 1 and a memory 2**).

The operation of sequentially displaying the two-dimensional sectional images on the display section 2 will now be explained, centered around the control device 40.

The two-dimensional sectional image data is transmitted from the two-dimensional sectional image memory 35 to the memories **42*a*, 42*b* through the selector 41, being transmitted to and stored in the memories 42*a*, 42*b* alternately. Also, the two-dimensional sectional layer image data in the memories 42*a*, 42*b* is transmitted from the memories 42*a*, 42*b* alternately to the latch 44 through the selector 43. Furthermore, the selectors 41, 43 are controlled in combination so that when the two-dimensional sectional image data is being transmitted from the selector 41 and stored in the memory 42*a*, for example, the selector 43 is reading out and transmitting the two-dimensional sectional image data from the memory 42*b*. Conversely, when the two-dimensional sectional layer data is being transmitted from the selector 41 and is stored in the memory 42*b*, the selector 43 is reading out and transmitting the two-dimensional sectional image data from the memory 42*a*. With this type of control, the two buffer memories 42*a*, 42*b* operate continuously without a pause. Specifically, the two buffer memories 42*a*, 42*b* are controlled alternately by the selectors 41, 43**.

When the position of the display section 2 is detected by the position detecting device 5, the address generator 46, according to this data, generates both an address signal which transmits data for the address of the two-dimensional sectional image data in either of the two buffer memories, the memory **42*a* and the memory 42*b*, and an address signal which controls the clock signal generator 45 which generates a signal to control the timing of the two-dimensional sectional image data to be transmitted to the display section 2 from the latch 44. The clock signal generator 45, in addition to controlling the timing of the display on the display section 2, also controls the time of display according to the display section 2. The three-dimensional image display device described for the present embodiment uses a drive mechanism which causes the display section 2** to move back and forth (vibrate) in a straight line.

A section exhibiting uniform velocity motion in a straight line and a section exhibiting accelerating and decelerating velocity motion are present in the display section 2. Even when display elements and the like are being displayed on the display section 2, it is necessary to control each of the uniform, accelerating, and decelerating velocity parts at the appropriate times.

Further, in the first embodiment, the relationship between the position of the display section 2 and the light-emission time of the light-emitting elements or the like is calculated and controlled by the calculation section 7.

In the second embodiment with this type of configuration, it is also possible to display three-dimensional shape data directly in three-dimensional space, utilizing the residual image effect of human vision in the same manner as in the previously-described first embodiment.

In addition, examples were explained for inputting shapes to both the first and second embodiments using input devices such as a keyboard, a mouse, or an image-reading scanner, or the like, independently, but this is in no way limitative of the present invention.

Specifically, various modifications of the system configuration of the three-dimensional image display device of the present invention are possible. For example, the three-dimensional image display device can be connected to other figure-treatment devices or a CAD or the like, and figure data transmitted from other figure-treatment devices or a CAD can be utilized. Also, the three-dimensional image display device of the present invention can be connected to an MRI device and, for example, sectional images of the human body can be input from the MRI device.

These sectional images can be formed so that they are displayed in sequence on the display section 2.

These various system configurations can also, of course, be applied to the following embodiments 3 to 7 of the present invention.

<Third Embodiment>

Figure 6:
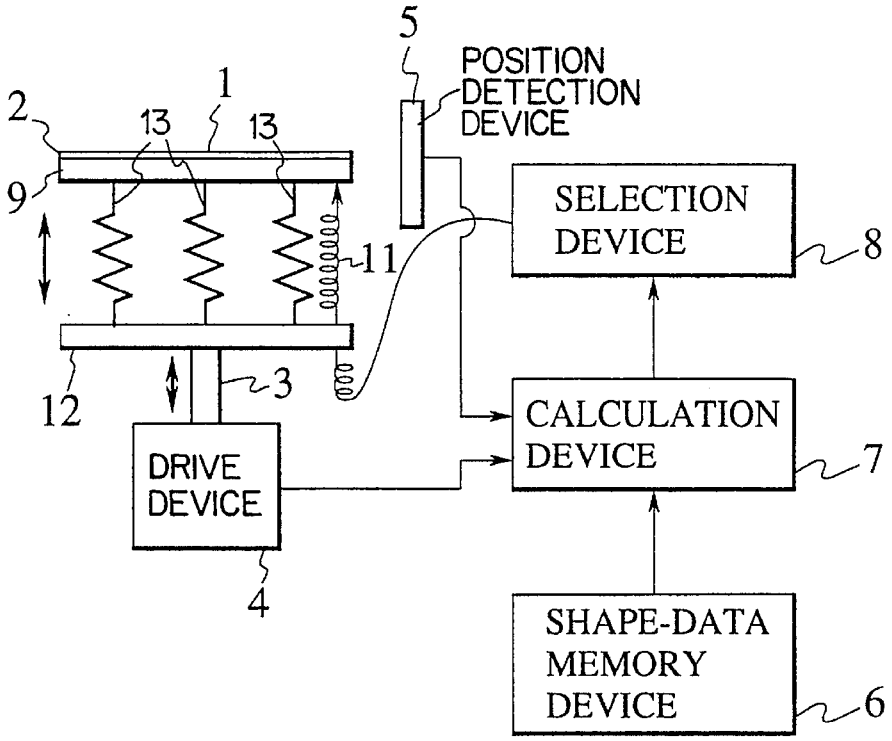
FIG. 6 is a general configuration drawing showing a second embodiment of a three-dimensional image display device of the present invention.

FIG. 6 is a general configuration drawing showing a third embodiment of a three-dimensional image display device of the present invention. In this embodiment, a plurality of coil-shaped springs 13 (three in the drawing) as elastic members are interposed via an intermediate pedestal 12 between the drive rod 3 connected to the drive device 4 and the display section 2 of the three-dimensional viewing device of the first embodiment shown in FIG. 1.

The coil of the signal line 11 led off from each of the light emitting elements 1 of the display section 2 is connected to the selection device 8 temporarily supported by the intermediate pedestal 12. The rest of the configuration and the operation for displaying the shape-data three-dimensionally on the display section 2 are the same as for the first embodiment shown in FIG. 1.

In addition, it is clear that the concept of the third embodiment according to the present invention can be applied to the configuration of the three-dimensional image display device as the second embodiment shown in FIG. 5.

In this embodiment, when the drive rod 3 is caused to vibrate (reciprocating motion) in the direction indicated by the arrow (the vertical direction in the drawing) through the drive action of the drive device 4, the vibration is transferred to the display section 2 through the intermediate pedestal 12 and the springs 13.

At this time, the drive device 4 which causes the drive rod 3 to vibrate (reciprocating motion) can provide a large vibrational displacement (amplitude) to the display section 2 with less power (less vibrational displacement of the drive rod 3) by being driven at or close to an inherent frequency determined by the display section 2, the springs 13, the intermediate pedestal 12, the drive rod 3, the drive device 4, and the like. At this time, the spring characteristics of the springs 13 are tuned so that the frequency of the display section 2, which is vibrationally driven by the drive device 4, is equivalent or close to the inherent frequency determined by the display section 2, the springs 13, the intermediate pedestal 12, the drive rod 3, the drive device 4, and the like; or the display section 2 is driven at a drive frequency almost equivalent to this inherent frequency.

Figure 7:
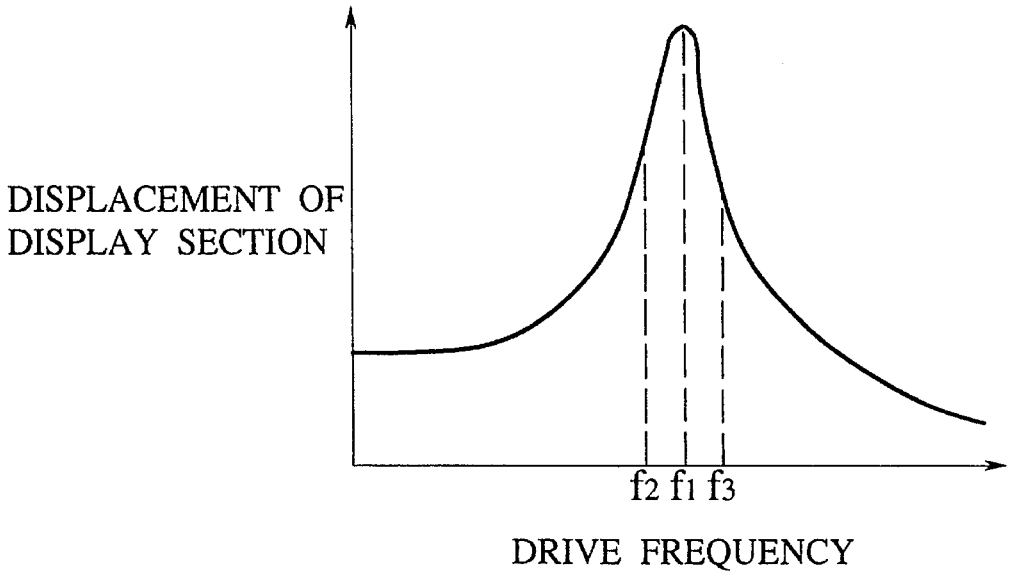
FIG. 7 is a graph showing the relationship between the displacement of the display section and the drive frequency of the display section of a drive device of the three-dimensional image display device shown in FIG. 6.

FIG. 7 is a graph showing the relationship between the drive frequency of the drive device 4 of the third embodiment of the present invention shown in FIG. 6 and the displacement (amplitude) of the display section 2. As can be clearly understood from this graph, by driving the drive device 4 at an inherent frequency f1 determined by the display section 2, the spring 13, the intermediate pedestal 12, the drive rod 3, the drive device 4, and the like, or at the frequencies f2, f3 close to this inherent frequency f1, a large vibrational displacement of the display section 2 is provided with less power (less vibrational displacement of the drive rod 3).

<Fourth Embodiment>

Figure 8:
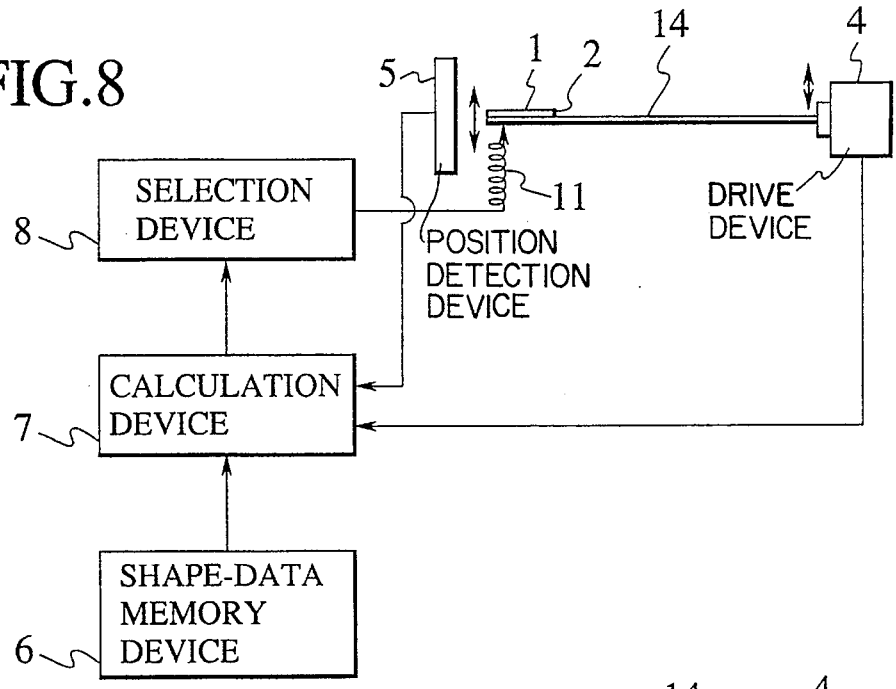
FIG. 8 is a general configuration drawing showing a fourth embodiment of a three-dimensional image display device of the present invention.

FIG. 8 is a general configuration drawing showing a fourth embodiment of a three-dimensional image display device of the present invention. This embodiment has a configuration wherein a plate spring 14, which is an elastic member, is connected to the drive device 4 in the horizontal direction, and the display section 2, on the upper surface of which a plurality of display elements 1 are arranged, is connected to the front end of the spring 14. The rest of the configuration and the operation for displaying the shape-data three-dimensionally on the display section 2 are the same as for the first embodiment shown in FIG. 1. In addition, it is clear that the concept of the fourth embodiment according to the present invention can be applied to the configuration of the three-dimensional image display device as the second embodiment shown in FIG. 5.

In this embodiment also, when the plate spring 14 is caused to vibrate (reciprocating motion) in the direction indicated by the arrow (the vertical direction in the drawing) through the drive action of the drive device 4, the display section 2 also vibrates (reciprocating motion) integrally with the plate spring 14.

At this time, the drive device 4 which causes the plate spring 14 to vibrate (reciprocating motion) by being driven at or close to an inherent frequency determined by the display section 2, the plate spring 14, the drive device 4, and the like, can provide a large displacement in the display section 2 with less power (less vibrational displacement of the drive device 4 side of the plate spring 14).

Further, in this embodiment, the forward end of the plate spring 14 vibrates so that it traces a pattern close to the arc of a circle, therefore, the display section 2 also vibrates in the same manner to trace an arc.

However, the front section of the plate spring 14 is vibrated either in a range in which there is no practical upper obstacle, or, during vibration which traces an arc, a specified compensation is carried out by the calculation device 7 so that a normal shape is obtained.

Therefore revised data is input and a shape close to normal is possible.

<Fifth Embodiment>

Figure 9:
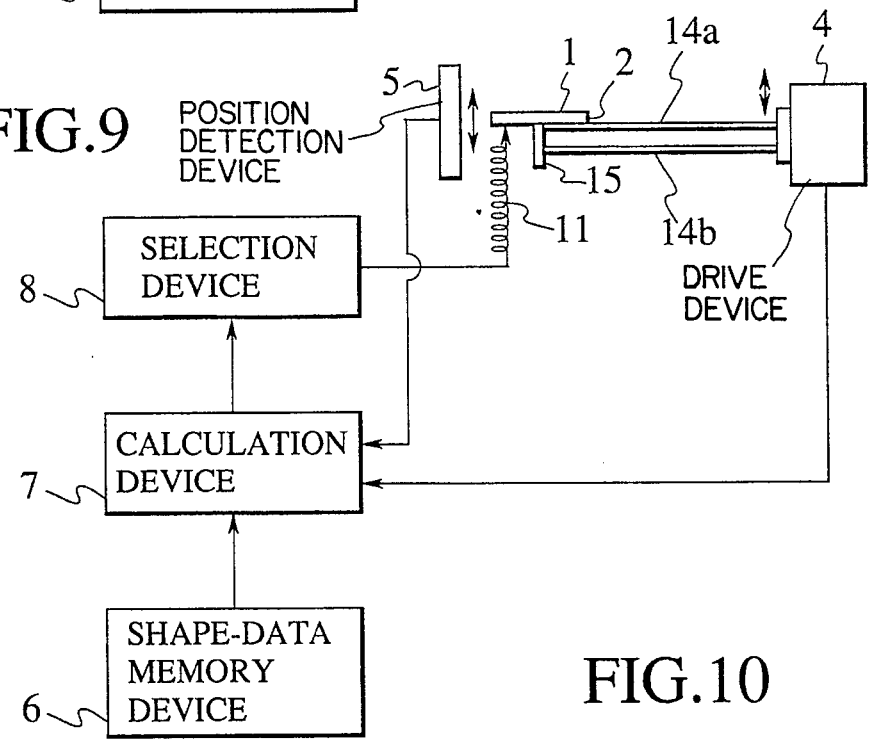
FIG. 9 is a general configuration drawing showing a fifth embodiment of a three-dimensional viewing device of the present invention.

FIG. 9 is a general configuration drawing showing a fifth embodiment of a three-dimensional image display device of the present invention. In this embodiment, a pair of plate springs 14*a*, 14*b* are joined in a horizontal plane placed one above the other, almost parallel to the drive device 4 of the fourth embodiment of the three-dimensional viewing device shown in FIG. 8, in a configuration in which the display section 2 is connected to the forward end of the plate spring 14*a*.

Figure 10:
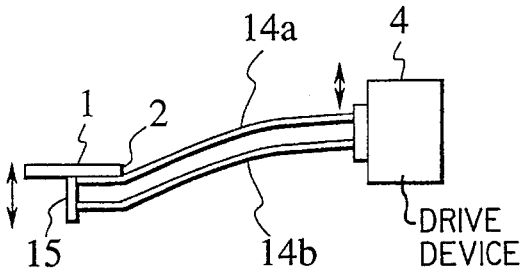
FIG. 10 is an explanatory diagram showing the displacement state of a plate spring contained in the three-dimensional image display device shown in FIG. 9.

The forward ends of the plate springs 14*a*, 14*b* are joined by means of a fixed member 15. The rest of the configuration and the operation for displaying the shape-data three-dimensionally on the display section 2 are the same as for the fourth embodiment shown in FIG. 8. In this embodiment, because the connected plate springs 14*a*, 14*b* are driven by the drive device 4 to vibrate (reciprocating motion) in the direction indicated by the arrows (the vertical direction in the drawing), and because the forward ends of the plate springs 14*a*, 14*b* vibrate (reciprocating motion) almost vertically (see FIG. 10), the display section 2 connected to the forward end of the plate spring 14*a* also vibrates (reciprocating motion) almost vertically.

Further, in the third and fourth embodiments, the spring characteristics of the springs 14, 14*a*, 14*b* are tuned so that the frequency of the display section 2 which is vibrationally driven by the drive device 4 is equivalent or close to an inherent frequency determined by the display section, the springs 14, 14*a*, 14*b*, the drive device 4, and the like; or the display section 2 is driven at a drive frequency almost equivalent to this inherent frequency. In this manner, in the three-dimensional image display device illustrated in the third to fifth embodiments, it is possible to make the vibrational displacement (amplitude) of the display section 2 large, even when the vibrational displacement (amplitude) for vibrating the display section 2 of the drive device 4 is small. It is therefore possible to reduce the size of the drive means 4 and reduce the operational vibration of the drive means itself.

<Sixth Embodiment>

The sixth embodiment of the three-dimensional image display device of the present invention will now be explained with reference to FIG. 11.

In the previously explained first, third, fourth, and fifth embodiments of the three-dimensional image display device, the position detection device 5, specifically the position detection sensor used as the position detection means, is provided on the outer portion of the display section 2 to detect the position of the display section 2 as the display means.

The vibrational position for each time interval of the display means 2 is detected by combining the position signal for the display section 2, transmitted from this position detection sensor and the signal showing the angle of rotation of a motor or the like as a structural element in the drive device 4. In this detection method, specifically, by the method for detecting the display means 2 from the angle of rotation of the motor, there are cases when it is not possible to obtain an accurate position for the display means 2 because of the deviation of the drive device 4 itself.

Figure 11:
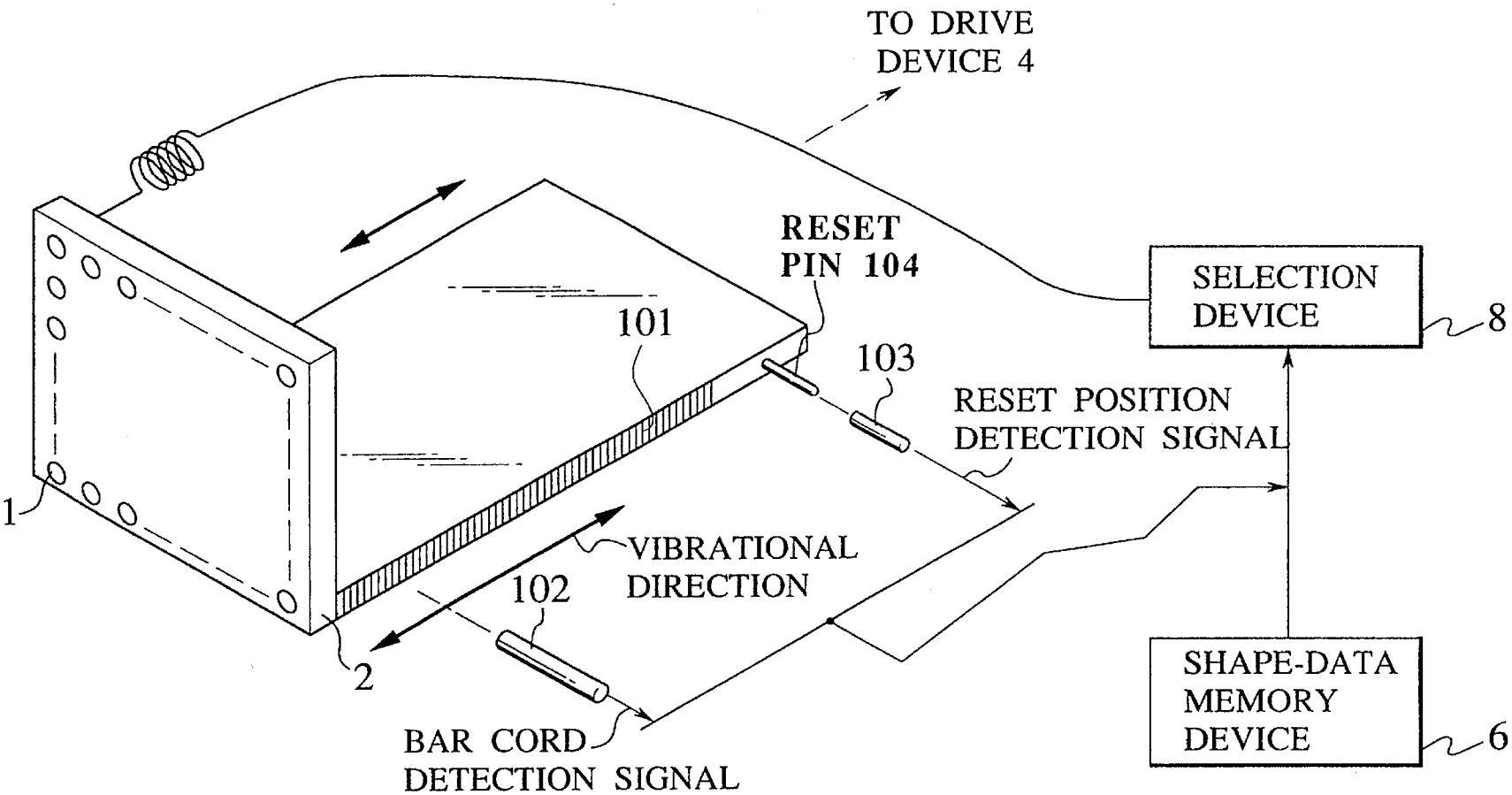
FIG. 11 is a general configuration drawing showing a sixth embodiment of a three-dimensional image display device of the present invention.

Accordingly, with the sixth embodiment of the three-dimensional image display device shown in FIG. 11, it is possible to obtain an accurate position for the display section 2 by using a bar code detection sensor 102 for detecting bar codes or slits provided on a position display section 101 connected perpendicular to the display surface of the display section 2.

In this case, the position of the display section 2 is directly detected by the position detection sensor 102. Further, the reference numeral 103 represents a reset position detection sensor used as a reset position detection part. The maximum amplitude position in the direction of vibration of the display section 2 can, for example, be detected by the detection of a reset pin 104 provided next to the position display section 101 by the reset detection sensor 103. The calculation device 7 can transmit the initial image data to the display section 2 based on this maximum amplitude position signal. The image data from the second and subsequent groups of data is transmitted in turn to the display section 2 from the selection device 8, based on the bar code position detection signal obtained by the position detection sensor 102 detecting the bar code or the slit.

Figure 12:
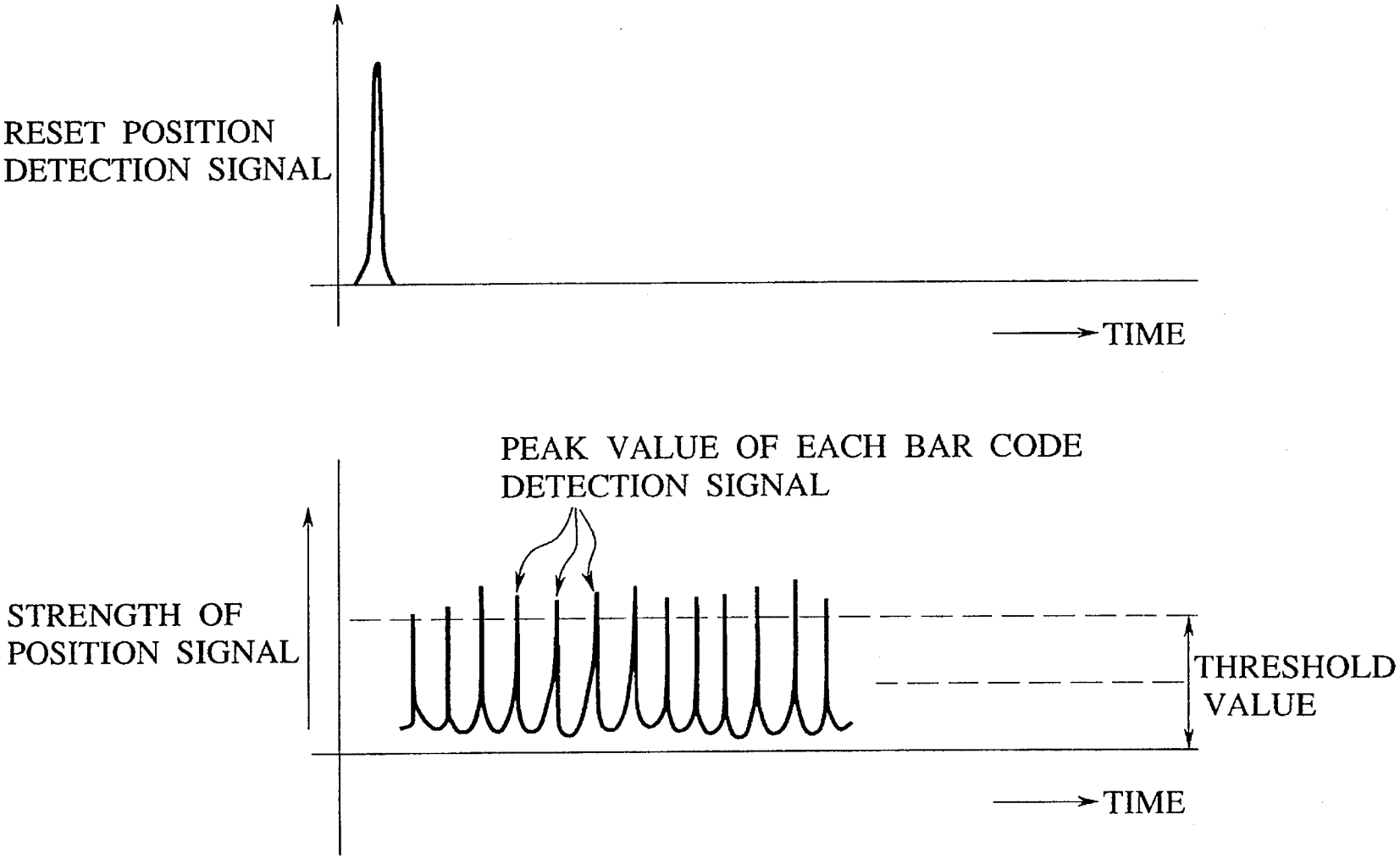
FIG. 12 is a diagram showing changes in a position signal of a bar code detected by a position detection sensor in the three-dimensional viewing device shown in FIG. 11.

FIG. 12 is a diagram showing each of the position signals of the bar code or the slits detected one after the other by the position detection sensor 102. The individual peaks which exceed the threshold value correspond to the various bar codes or the slits. Then, in the selection device 8, each time a position signal exceeds the threshold value the images are transmitted in sequence to the display section 2 via the selection means.

In addition, it is also possible that the data of the reset position is included in a part of the bar codes or the slits in the position display section 101 instead of the reset pin 104 and the reset position detection sensor 103 to detect the reset position by using the position detection sensor 102.

Further, the position detection sensor 102 is used to detect the position of the display section 2 in the above-mentioned sixth embodiment of the three-dimensional image display device, but the same effect can be obtained using a displacement gauge or the like instead of the position detection sensor.

Figure 13:
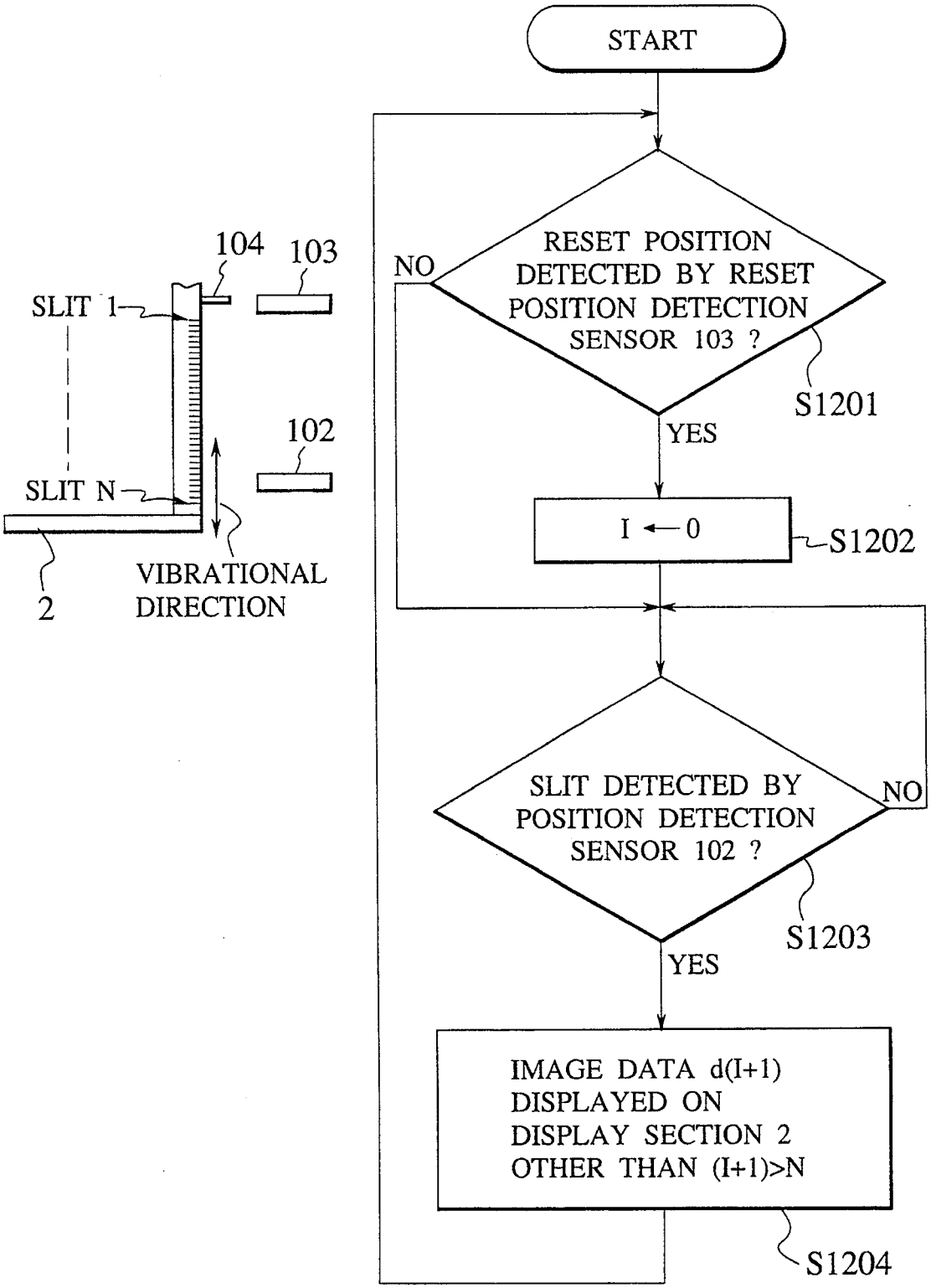
FIG. 13 is a flow chart showing the operation of the sixth embodiment of a three-dimensional image display device shown in FIG.11.

FIG. 13 is a flow chart showing the operation of the sixth embodiment of the three-dimensional image display device shown in FIG. 11. In the drawing, in step S1201 a judgement is made whether or not the reset position detection sensor 103 has detected a reset position determined in advance on the position display section 101. For example, the reset pin 104 is selected as this reset position. In addition, the position detection sensor 102 is provided so that it can detect all of the N bar codes or the N slits when N two-dimensional sectional images are displayed continuously.

In Step S1202, in the case where the reset position has been detected in step S1201, a variable I is set at "0". As a result, the initial image data is displayed on the display section 2 in step S1204.

In Step S1203, the next bar code n or the next slit n is detected by the position detection sensor 102, and the program proceeds to the next step S1204 only in the case where this detection signal exceeds a previously set threshold value, as shown in FIG. 12.

In Step S1204, the image data corresponding to the detected bar code n or slit n is displayed on the display section 2. In this step, it is not required to display the image data corresponding to d(I+1) when (I+1) is greater than N, because there is no image data of d(I+1).

However, in the sixth embodiment of the three-dimensional image display device shown in FIG. 11, the image data is transmitted only in a specified direction which is either the advancing or retreating direction of the display section 2. It is possible to obtain a clearer image if the image data is transmitted to the display section 2 for both directions.

<Seventh Embodiment>

Figure 14:
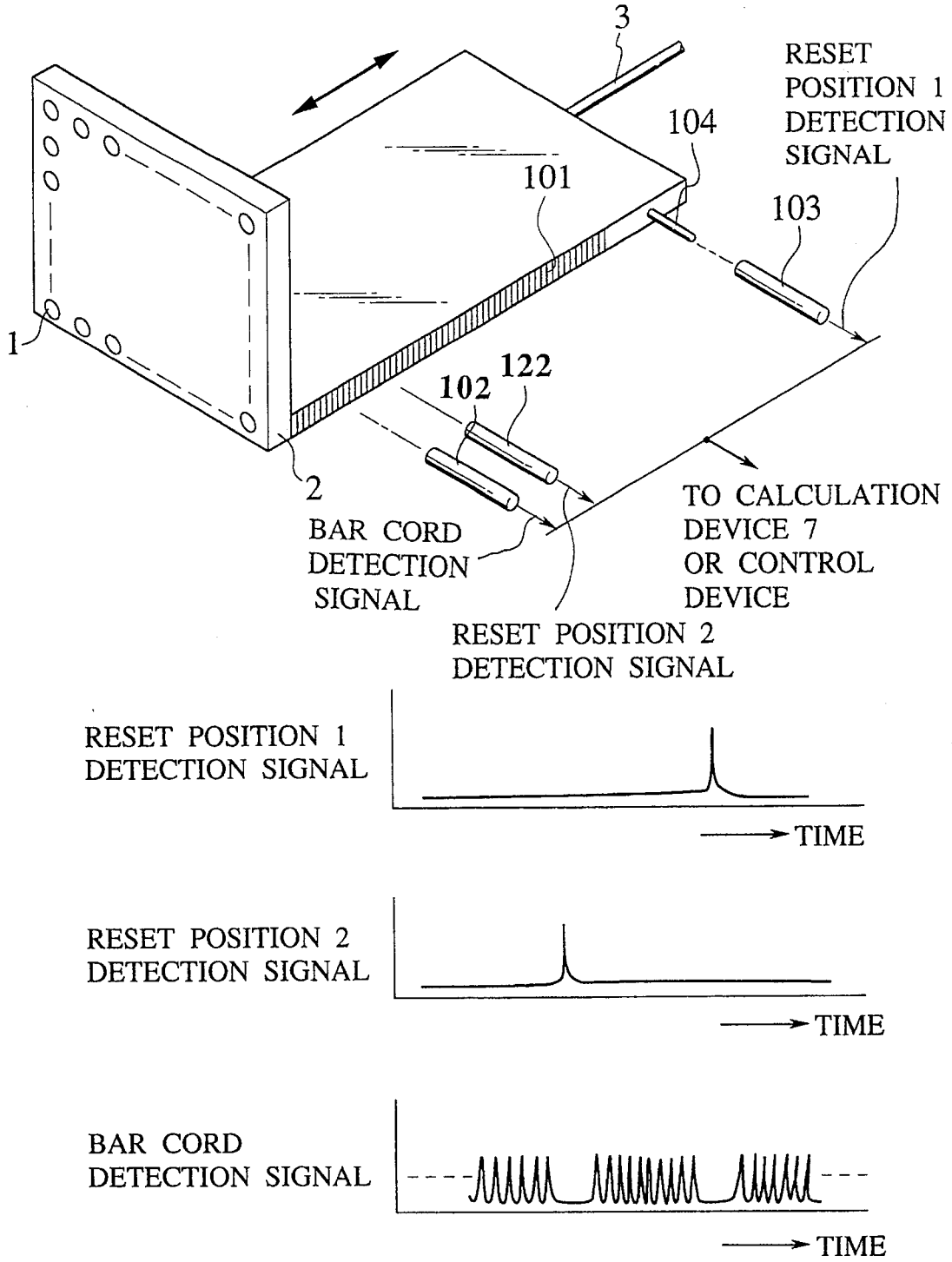
FIG. 14 is a general configuration drawing showing a seventh embodiment of a three-dimensional image display device of the present invention.

FIG. 14 shows a seventh embodiment of the three-dimensional image display device of the present invention. A reset position sensor 122 is added to the configuration of the sixth embodiment of the three-dimensional image display device.

The reset position sensors 103, 122 detect the transfer position, for example, the position of the reset pin 104 positioned at the maximum amplitude position in the reciprocating vibration of the display section 2.

Figure 15:
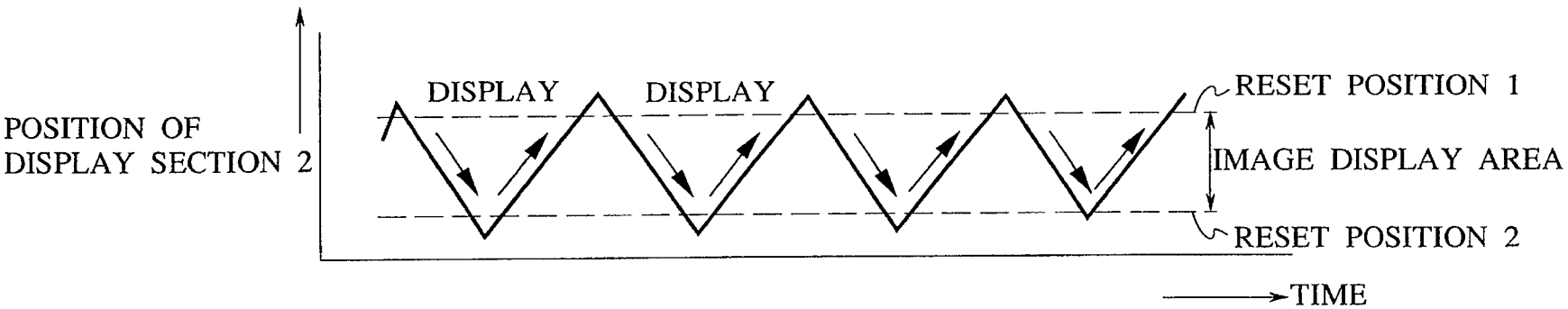
FIG. 15 is a diagram showing changes in the vibrational position of the display section in the three-dimensional image display device shown in FIG. 14.

In addition, as shown in FIG. 15, by use of the three-dimensional image display device of FIG. 14, the image data is displayed on the display section 2 for both advancing and retreating directions during the reciprocating motion of the display section 2. As a result, when using a drive frequency which is the same as the drive frequency of the display section 2 used in the sixth embodiment of tile three-dimensional image display device, the three-dimensional image is displayed at apparently twice that drive frequency and a clear three-dimensional image can be displayed.

Figure 16:
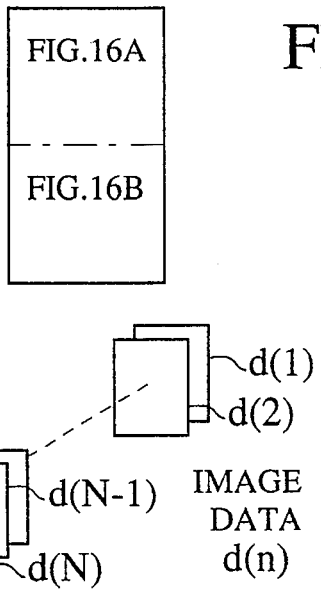
FIG. 16 is a flow chart showing the operation of the seventh embodiment of a three-dimensional image display device shown in FIG. 14.
Figure 16A:
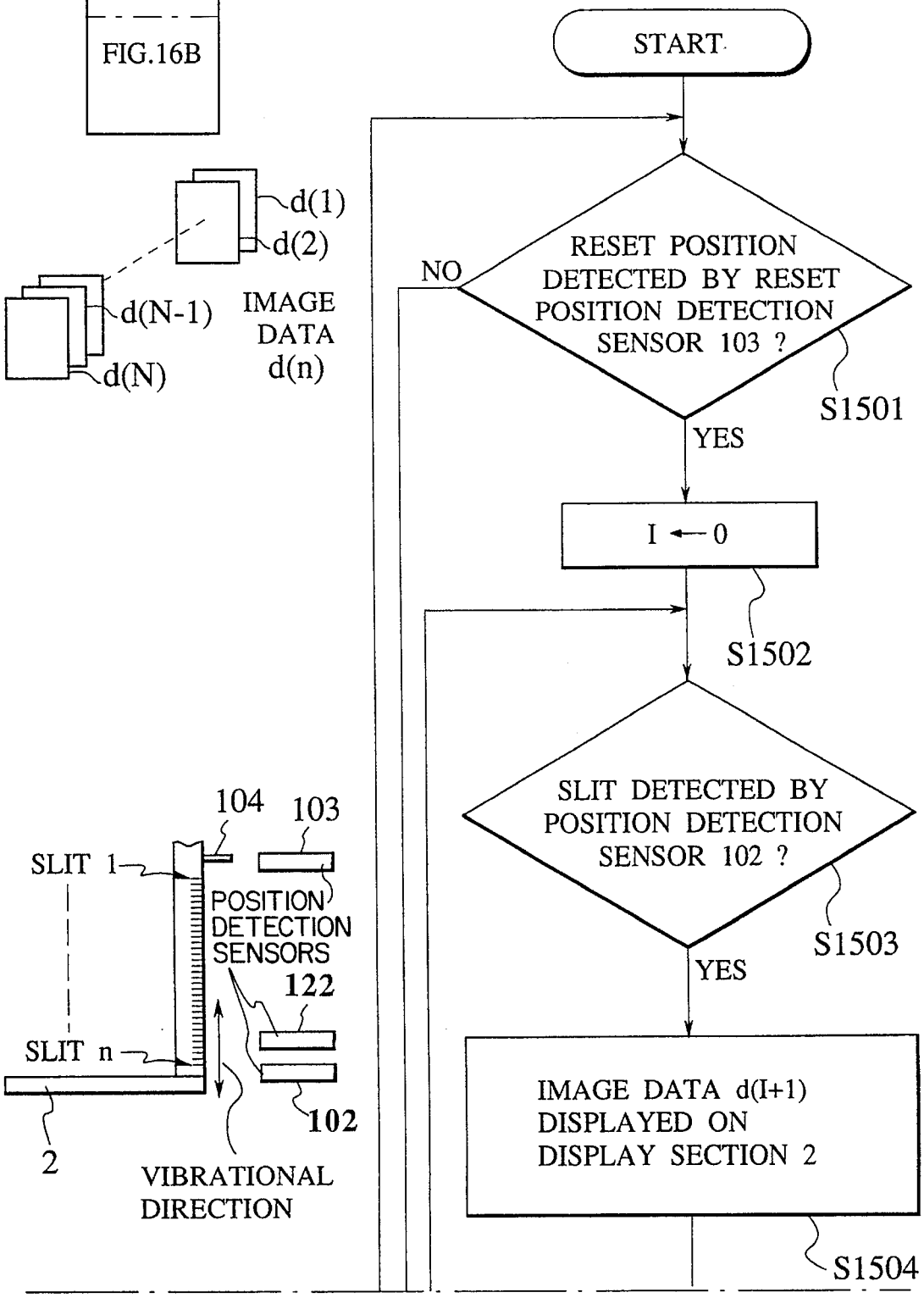
Figure 16B:
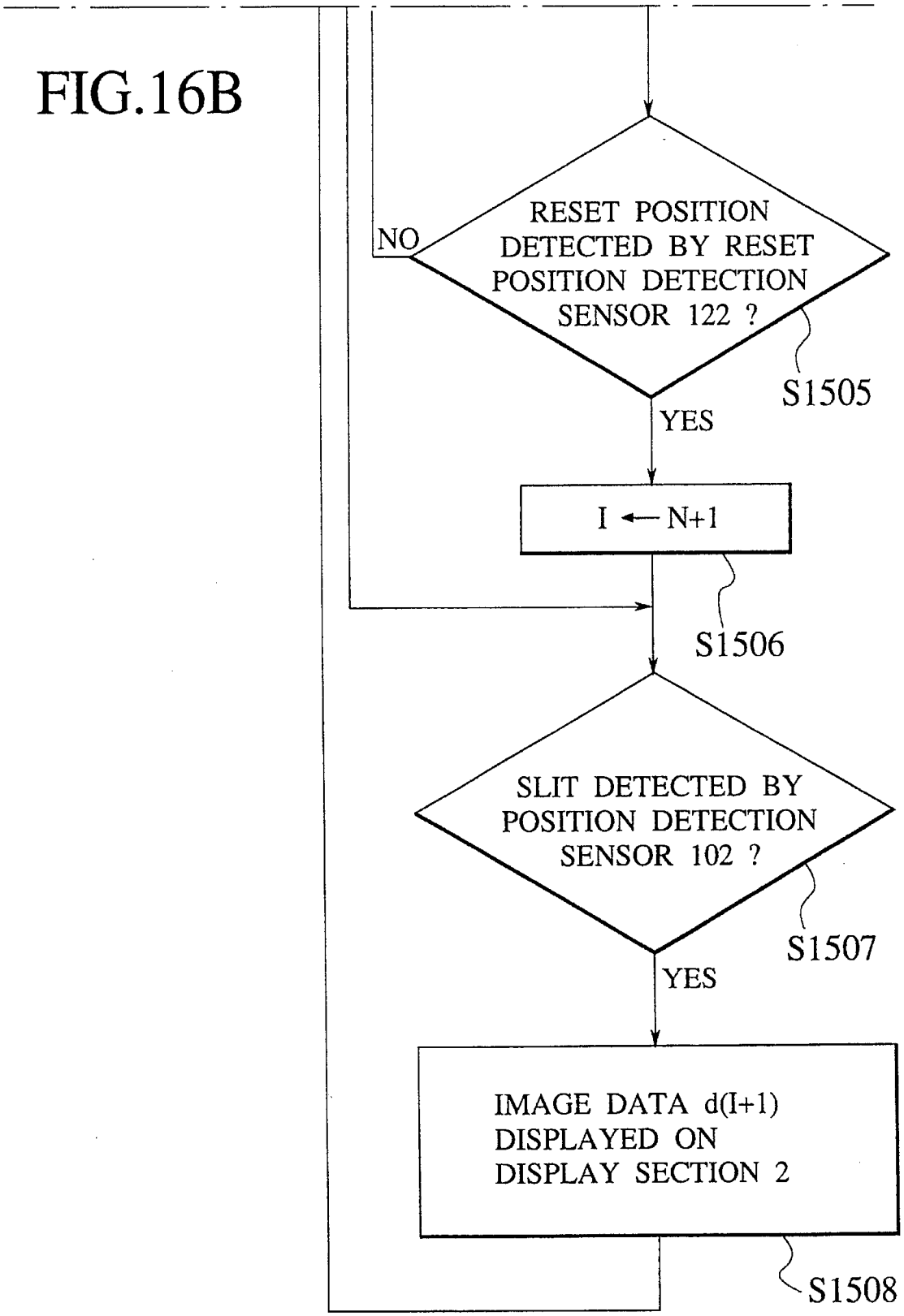

FIG. 16 is a flow chart showing the operation of the seventh embodiment of the three-dimensional image display device shown in FIG. 14. In the drawing, in step S1501 a judgement is made whether or not the reset position detection sensor 103 has detected a reset position determined in advance. For example, the reset pin 104 provided next to the position display section 101 is set as this reset position. In addition, the position detection sensors 103, 122 are provided at the maximum amplitude position of this slot.

In Step S1502, in the case where the reset position has been detected in step S1501, a variable I is set at "0". As a result, the initial image data is displayed on the display section 2 in step S1504.

In Step S1503, the next bar code n or the next slit n is detected by the position detection sensor 102, and the program proceeds to the next step S1504 only in the case where this detection signal exceeds a previously set threshold value, as shown in FIG. 11.

In Step S1504, the image data corresponding to the detected bar code n or the detected slit n is displayed on the display section 2. This occurs for the case of the advancing direction during the vibration amplitude of the display section 2.

Next, the image display on the display section 2 in the case of the retreating direction during the vibration amplitude of the display section 2 will be explained. In step S1505 a Judgement is made whether or not the reset position detection sensor 122 has detected a reset position determined in advance on the position display section 101. In Step S1506, in the case where the reset position has been detected in step S1505, a variable I is set at "N". "N", for example, is the maximum number of bar codes or slits.

In Step S1507, the next bar code n or the next slit n is detected by the position detection sensor 122, and the program proceeds to the next step S1508 only in the case where this detection signal exceeds a previously set threshold value, as shown in FIG. 11.

In Step S1508, the image data corresponding to the detected bar code n or the detected slit n is displayed on the display section 2. After the image data has been displayed on the display section 2 in Step S1508, the program reverts to step 1501, and the above steps are repeated.

As shown by the above explanation, when the same drive frequency used as the drive frequency for the display section 2 used for the sixth embodiment of the three-dimensional image display device is used in the seventh embodiment of the three-dimensional image display device, a three-dimensional image is displayed which apparently uses twice the drive frequency.

In other words, if the configuration of the sixth embodiment of the three-dimensional image display device is used, it is possible to obtain three-dimensional images of the same quality as the three-dimensional images obtained in the sixth embodiment by using half the drive frequency used for the sixth embodiment of the three-dimensional image display device as the drive frequency of the display section 2.

The light emitting element 1, which may be an LED or the like, is used as the display element of the display section 2 in the above-described embodiments of the present invention. However, it is also possible to display three-dimensional shape-data in the same manner on the display section 2 by using, for example, a plasma display on the display section 2, or by using liquid crystals which show optical changes such as color or transparency or the like when exposed to an electric field or a magnetic field or the like.

The same effect can also be obtained with a configuration using a light-emitting plate coated with a light-emitting material applied to the display section 2 and directing a laser beam or the like onto the display section.

The case of a simple cylinder as the three-dimensional shape displayed on the display section 2 is described for the foregoing embodiments, but it is also possible to display complicated three-dimensional shapes and motion. By means of the present invention, it is possible to easily display shape-data directly in three-dimensional space, utilizing the residual image effect of human vision. Also, according to the present invention, even if the vibrational displacement (amplitude) for vibrating the display means of the drive means is low, by interposing an elastic member it is possible to increase the vibrational displacement (amplitude) of the display means, making it possible to reduce the size of the drive means and to reduce the operational vibration of the drive means, to efficiently display shape-data three-dimensionally.

What is claimed is:

1. A three-dimensional image display device comprising:

display means comprising a display member, said display member comprising a plurality of display elements arranged in a desired arrangement, each of said plurality of display elements producing light-emission or optical variations by means of an external electrical, magnetic, or optical operation;

drive means for moving the display means in a reciprocating motion toward specified directions with respect to the display surface of the display means;

shape data memory means for storing two-dimensional sectional images for displaying on the display means;

position detection means for detecting a start position in each of a back direction and a forth direction in the reciprocating motion of the display means while the display means is moving in the reciprocating motion; and control means for controlling so that a specified part of the display member emits light or produces an optical variation for a specified time only, utilizing positional data from the position detection means in order to display the two-dimensional sectional images on the display means in sequence while the display means is moving in the reciprocating motion, wherein the control means causes the two-dimensional sectional images to be displayed in sequence in an advancing path and a retreating path of the display means while the display means is vibrating.

2. A three-dimensional image display device as claimed in claim 1, wherein a flexible member is interposed between the display means and the drive means.

3. A three-dimensional image display device as claimed in claim 2, wherein the display means is moving in the reciprocating motion at the drive frequency of the drive means so that the vibration characteristics of the flexible member are tuned almost in agreement with an intrinsic frequency determined by the drive means, the flexible member, and the display means, or the drive frequency is made almost equivalent to the intrinsic frequency.

4. A three-dimensional image display device as claimed in claim 1, wherein the control means further comprises a plurality of auxiliary memory means for reading out the two-dimensional sectional images stored in the shape data memory means, and the control means controls so that the two-dimensional sectional images are read out alternately from the plurality of the auxiliary memory means and said specified part of the display member emits light or produces an optical variation for a specified time only corresponding to the two-dimensional sectional images which have been read out, at a specified vibrational position of the display means in the reciprocating motion.

5. A three-dimensional image display device as claimed in claim 4, wherein the control means further comprises:

memory switching means for implementing switching control so that, at a first optional timing, a first of the auxiliary memory means is selected to which a two-dimensional sectional image is transmitted and stored whenever a two-dimensional sectional image is read out in sequence from within the shape data memory means and transmitted to the auxiliary memory means; and read-out switching means for implementing switching control so that, at a second optional timing, a second of the auxiliary memory means is selected to which a two-dimensional sectional image is transmitted, whenever a two-dimensional sectional image stored in the auxiliary memory means is read out in sequence and transmitted to the display means.

6. A three-dimensional image display device as claimed in claim 4, wherein the control means further comprises:

discriminating signal generating means for generating a discriminating signal based on a signal from the position detection means; and timing signal generating means for generating a timing signal for controlling the timing of the display of the two-dimensional sectional images on the display means, wherein one of the auxiliary memory means is selected based on the discriminating signal and the two-dimensional sectional image is read out and displayed on the display means, based on the timing signal.

7. A three-dimensional image display device as claimed in claim 4, wherein the auxiliary memory means comprises a first auxiliary memory means and a second auxiliary memory means; and wherein the control means reads out and transmits shape data to the display means from the second auxiliary memory means in the midst of the transmission and recording of the shape data in the first auxiliary memory means from the shape data memory means; and the control means reads out and transmits shape data to the display means from the first auxiliary memory means in the midst of the transmission and recording of the shape data in the second auxiliary memory means from the shape data memory means.

8. A three-dimensional image display device as claimed in claim 1, wherein the position detection means comprises:

amplitude position display means attached to the display means for displaying a plurality of vibrational position data items on the display member within the amplitude while the display means is moving in the reciprocating motion, and for displaying reset positional data for transmitting data for two-dimensional sectional images to the display means; and position detection sensor means for reading the position data items and the reset positional data on the amplitude position display means.

9. A three-dimensional image display device as claimed in claim 8, wherein the position detection sensor detects a position close to the upper limit of the vibrational amplitude of the display means as reset position data, and wherein the control means, when the position detection sensor detects this reset position data, commences the transmission of the two-dimensional sectional image data from the shape data memory means to the display means, and controls so that the two-dimensional sectional layer image data corresponding to the vibrational position data is transmitted to the display means each time the position detection sensor detects the vibrational position data.

10. A three-dimensional image display device as claimed in claim 8, wherein the position data items and the reset positional data are stored with first reset position data indicating a position close to the upper limit of the vibration amplitude of the display means and second reset position data indicating a position close to the lower limit of the vibration amplitude of the display means, and wherein the control means, when the position detection sensor detects the first reset position data, commences the transmission of the two-dimensional sectional image data from the shape data memory means to the display means, and, in addition, controls so that the two-dimensional sectional image data corresponding to the vibrational position data is transmitted to the display means each time the position detection sensor detects the vibrational position data, and the control means, when the position detection sensor detects the second reset position data, commences the transmission of the two-dimensional sectional image data from the shape data memory means to the display means, and, in addition, controls so that the two-dimensional sectional image data corresponding to the vibrational position data is transmitted to the display means each time the position detection sensor detects the vibrational position data.

11. A three-dimensional image display device as claimed in claim 8, wherein the number of the position detection sensor means is two.

12. A three-dimensional image display device as claimed in claim 1, wherein the control means comprises:

calculation means for performing calculations for producing the light emission or optical variation at a specified part of the display member for a specified time only at a specified vibrating position of the display means in the reciprocating motion, utilizing the positional data from the position detection means; and selection means for selecting a specified part of the display means for displaying a two-dimensional sectional image on the display member and outputting a signal for producing the light emission or optical variation at a part of the display means selected to conform to the vibrating position of the display means in the reciprocating motion, based on the results of the calculations supplied from the calculation means.

13. A three-dimensional image display device as claimed in claim 1, wherein the shape data memory means comprises:

three-dimensional shape generation means for implementing a three-dimensional shape process for generating a three-dimensional shape based on data input through an input means;

three-dimensional shape memory means for storing three-dimensional shape data prepared by the three-dimensional shape generation means;

two-dimensional sectional image generation means for generating two-dimensional sectional images displayed on the display means for displaying three-dimensional shapes in the vibrational amplitude space of the display means, based on three-dimensional shape data stored in the three-dimensional shape memory means; and two-dimensional sectional image memory means for storing two-dimensional sectional image data generated in the two-dimensional sectional image generation means.

14. A three-dimensional image display device as claimed in claim 1, wherein the position detection means detects each specified position of advancing and retreating paths of the display means in the reciprocating motion, and the two-dimensional sectional image is displayed in each of the advancing and retreating paths of the displays means while the display means is moving in the reciprocating motion, by the control means, corresponding to a signal from the position detection means.

15. A three-dimensional image display device as claimed in claim 1, wherein the drive means has the function of causing the display means to vibrate in a direction almost at right angles to the display surface of the display means.

16. A three-dimensional image display device as claimed in claim 1, wherein the display means is formed from LEDs.

17. A three-dimensional image display device as claimed in claim 1, wherein the display means is formed from a liquid crystal display.

18. A three-dimensional image display device as claimed in claim 1, wherein the display means is formed from a plasma display.

19. A three-dimensional image display device as claimed in claim 1, wherein the display means is formed from a fluorescent surface member, the surface of which is coated with a fluorescent material.

20. A three-dimensional image display device comprising:

display means comprising: a display member, said display member comprising a plurality of display elements arranged in a desired arrangement, each of said plurality of display elements producing light-emission or optical variations by means of an external electrical, magnetic, or optical operation;

drive means for moving the display means in a reciprocating motion toward specified directions with respect to the display surface of the display means;

a flexible member positioned between the display means and the drive means;

shape data memory means for storing two-dimensional sectional images for displaying on the display means;

position detection means for detecting the position of the display means while the display means is moving in the reciprocating motion; and control means for controlling so that a specified part of the display member emits light or produces an optical variation for a specified time only, utilizing positional data from the position detection means in order to display the two-dimensional sectional images on the display means in sequence while the display means is moving in the reciprocating motion, wherein the display means is vibrated at the drive frequency of the drive means so that the vibration characteristics of the flexible member are tuned almost in agreement with an intrinsic frequency determined by the drive means, the flexible member, and the display means, or the drive frequency is made almost equivalent to the intrinsic frequency.

21. A three-dimensional image display device comprising:

display means comprising a display member, said display member comprising a plurality of display elements arranged in a desired arrangement, each of said plurality of display elements producing light-emission or optical variations by means of an external electrical, magnetic, or optical operation;

drive means for moving the display means in a reciprocating motion toward specified directions with respect to the display surface of the display means;

shape data memory means for storing two-dimensional sectional images for displaying on the display means;

position detection means for detecting each vibrating position of the display means and each initial position of the advancing and retreating paths of the display means while the display means is moving in the reciprocating motion;

control means for controlling so that a specified part of the display member emits light or produces an optical variation for a specified time only, at a specified vibrational position of the display means after detecting each initial position of the advancing and retreating paths of the display means utilizing positional data from the position detection means, and for controlling so that the two-dimensional sectional layer images are displayed in sequence in each of the advancing and retreating paths of the display means while the display means is moving in the reciprocating motion.

* * * * *